US006250826B1

(12) United States Patent
Kato

(10) Patent No.: US 6,250,826 B1
(45) Date of Patent: Jun. 26, 2001

(54) INK RIBBON, CARTRIDGE CONTAINING INK RIBBON, AND METHOD OF DISCRIMINATING FAILURE LOCATION FROM INK RIBBON BASE FILM

(75) Inventor: Atsuhiro Kato, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/378,187

(22) Filed: Aug. 20, 1999

(30) Foreign Application Priority Data

Aug. 26, 1998 (JP) ..... 10-240652

(51) Int. Cl.[7] ..... B41J 31/09
(52) U.S. Cl. ..... 400/237; 400/621.1
(58) Field of Search ..... 400/237, 621.1, 400/197, 202.1, 240.3, 240; 118/38, 37

(56) References Cited

U.S. PATENT DOCUMENTS

| | | | | |
|---|---|---|---|---|
| 2,833,666 | * | 5/1958 | Neidich | 118/38 |
| 3,608,139 | * | 9/1971 | Wahlstrom | 118/38 |
| 4,119,452 | * | 10/1978 | Stolpe et al. | 118/37 |
| 4,797,016 | | 1/1989 | Lahr . | |
| 5,185,315 | * | 2/1993 | Sparer | 400/240.3 |
| 5,289,210 | | 2/1994 | Takayanagi . | |
| 5,325,115 | * | 6/1994 | Tanahashi | 400/240.3 |
| 5,366,307 | | 11/1994 | McGourty et al. . | |
| 5,466,075 | * | 11/1995 | Kouzai et al. | 400/240.3 |
| 5,567,066 | | 10/1996 | Paranjpe . | |
| 5,853,255 | | 12/1998 | Soshi et al. . | |

FOREIGN PATENT DOCUMENTS

| | | | | |
|---|---|---|---|---|
| 0095986 | * | 4/1988 | (JP) | 400/237 |
| 404314576 | * | 11/1992 | (JP) | 400/237 |

* cited by examiner

*Primary Examiner*—Ren Yan
*Assistant Examiner*—Anthony H. Nguyen
(74) *Attorney, Agent, or Firm*—J. William Wigert, Jr.; Crosby, Heafey, Roach & May

(57) ABSTRACT

This invention relates to an ink ribbon, a cartridge containing the ink ribbon and a method of discriminating a failure location from an ink ribbon base film when the failure occurs on the ink ribbon. The ink ribbon is a sublimation-type ink ribbon manufactured from a column of the plural columns into which the ink ribbon base film is cut. The ink ribbon has a recording portion for recording column information indicating a column out of the plural columns of the ink ribbon base film, from which the ink ribbon is manufactured. The cartridge contains the ink ribbon. When a failure occurs on the ink ribbon, the column including the failure is discriminated from the plural columns of the ink ribbon base film based upon the recorded column information of the ink ribbon.

10 Claims, 6 Drawing Sheets

INK RIBBON, CARTRIDGE CONTAINING INK RIBBON, AND METHOD OF DISCRIMINATING FAILURE LOCATION FROM INK RIBBON BASE FILM

BACKGROUND OF THE INVENTION

1. Technical Field of the Invention

The present invention relates to an ink ribbon, a cartridge containing the ink ribbon and a method of discriminating a failure location from an ink ribbon base film when the failure occurs on the ink ribbon.

2. Description of the Related Art

Generally, an ink ribbon used in a thermal transfer printer is manufactured from ink ribbon base film. The ink ribbon base film is manufactured by applying a back coat layer to a back of a thin film as a film base material with a thickness of approximately a few μm made of polyethylene and others, applying an undercoat layer to a surface of the film and coating the undercoat layer with ink material by a gravure coater and others to form an ink layer. Next, the above ink ribbon base film is cut into plural columns (for example, into three columns) and then three small windings called a pancake are made therefrom. Each of the ink ribbons is manufactured from the pancake by winding the film of pancake on a spool.

The ink layer contains sublimation-type ink and a thermal head sublimates the ink by heating it via the film base material. In printing, the sublimated ink is transferred and fixed on paper to receive an image, said paper being closely touched to the ink layer. At that time, as a quantity of sublimated ink can be controlled based upon a quantity of heat applied to a thermal head, continuous gradation can be applied to the density of printing.

In the above ink ribbon, however, failure such as the unevenness of each color ink often occurs in an ink ribbon manufactured using a specific column of ink ribbon base film. A column of the ink ribbon base film from which the failed ink ribbon is manufactured cannot be discriminated only by looking at the failed ink ribbon. As a result, when the failure occurs in an ink ribbon, a column in which the failure occurs cannot be discriminated from the plural columns of the ink ribbon base film.

SUMMARY OF THE INVENTION

The object of the present invention is to provide an ink ribbon, a cartridge containing the ink ribbon and a method of discriminating a failure location from ink ribbon base film when the failure occurs in the ink ribbon wherein the failure location on the ink ribbon base film can be discriminated by providing the ink ribbon with a recording portion for recording column information indicating a column of any ink ribbon base film, from which an ink ribbon is manufactured.

In carrying out the invention in one preferred embodiment, I provide an ink ribbon manufactured by cutting ink ribbon base film into plural columns comprising a recording portion for recording column information indicating a column out of the plural columns of the ink ribbon base film, from which the ink ribbon is manufactured.

Also, plural types of ink are applied to the ink ribbon and the above recording portion is provided between areas covered by each of the inks in the ink ribbon.

The recording portion of the ink ribbon according to the present invention includes a printed mark.

The mark of the ink ribbon according to the present invention is composed of a sensor code.

As another preferred embodiment, I provide a cartridge containing the above ink ribbons.

Further, I provide, as still another preferred embodiment, a method of discriminating a failure location from ink ribbon base film. Column information indicating a column, from which the ink ribbon is manufactured, out of the plural columns of the ink ribbon base film, is recorded on a recording portion of the ink ribbon. When failure occurs in the ink ribbon, a column including the failure is discriminated from the plural columns of the ink ribbon base film based upon the above column information of the ink ribbon.

A further understanding of the nature and advantages of the invention may be realized by reference to the following portions of the specification and drawings.

DESCRIPTION OF THE PREFERRED EMBODIMENT

Figure 1:
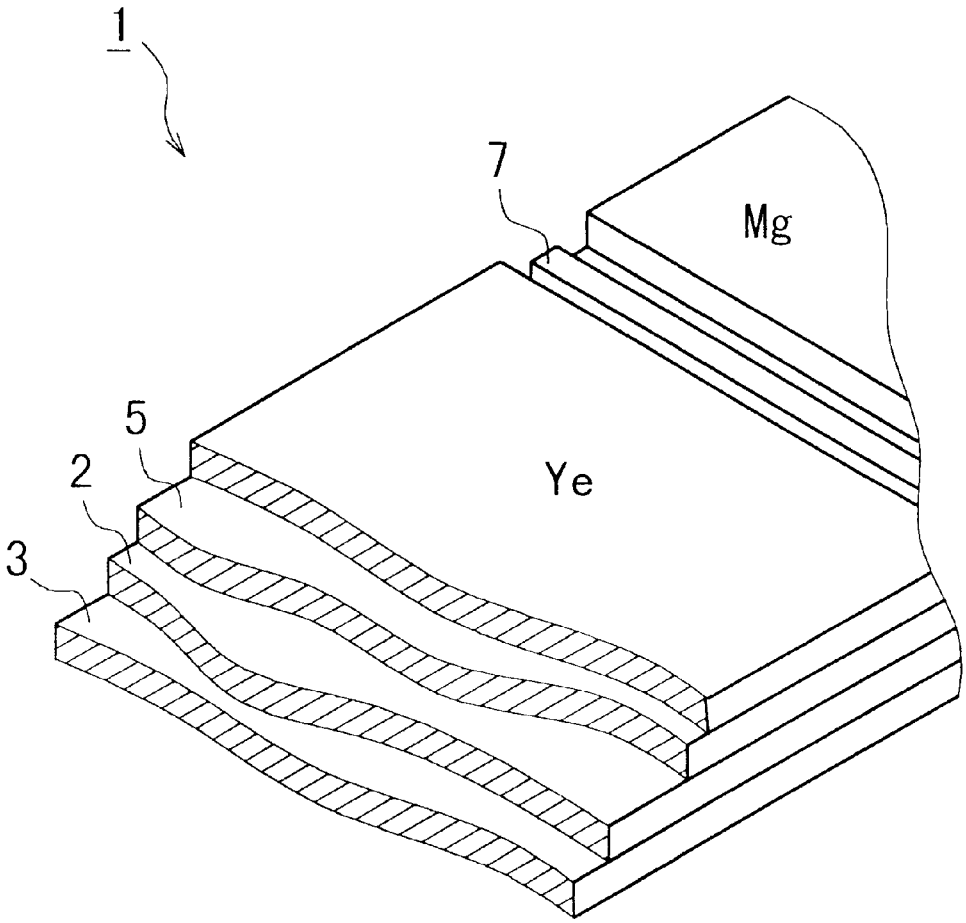
FIG. 1 is a view showing the sectional structure of an ink ribbon base film according to the present invention.

Referring to the drawings, a preferred embodiment of a sublimation-type ink ribbon and ink ribbon base film according to the present invention will be described below.

To manufacture the sublimation-type ink ribbon according to the present invention, a ink ribbon base film (hereinafter called a jumbo roll) is firstly made so that a back coating layer is applied to the back of a thin film with a thickness of approximately a few μm made of polyethylene and others as film base material, an undercoat layer is applied to a surface of the film, an undercoat layer is coated with ink material by a gravure coater and others to form an ink layer.

Next, the above jumbo roll is cut into plural columns (for example, into three columns) and three small windings are made. Each of the small windings is referred to a pancake. The cut film in a state of the above pancake is wound on spools and then each of the plural ink ribbons is manufactured.

According to the present invention, a recording portion indicating column information is attached to the ink ribbon in the manufacturing process of the above jumbo roll. The column information contains information corresponding to a column of the jumbo roll, from which the ink ribbon is manufactured. If failure occurs in an ink ribbon, the column including the failure can be discriminated from the plural columns of the ink ribbon base film based upon the column information in the recording portion of the ink ribbon. Thereby, the column of the jumbo roll including the failure can be discriminated.

Figure 2:
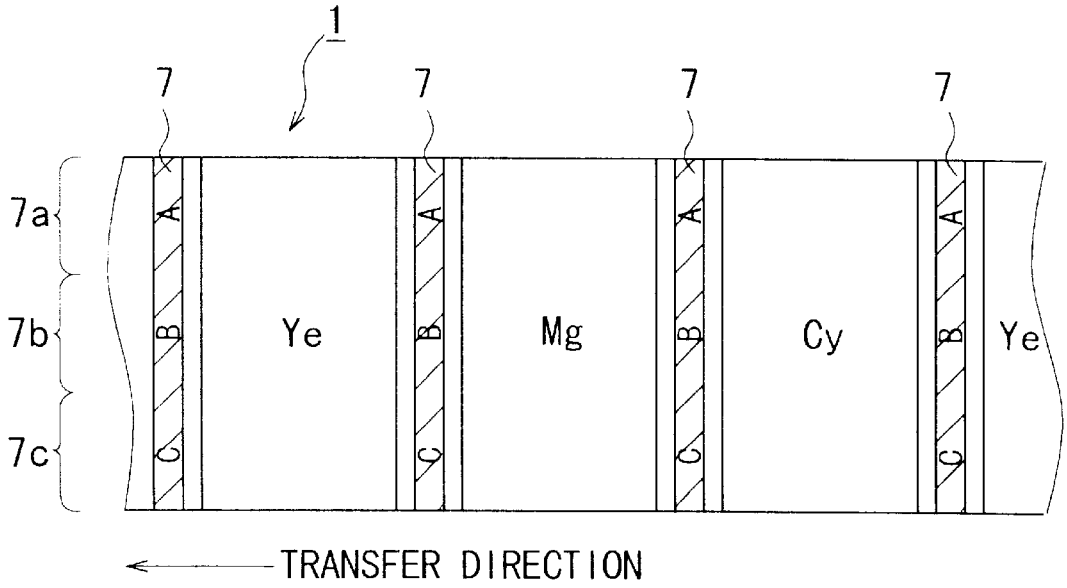
FIG. 2 is a plan view showing the ink ribbon base film according to the present invention.

A jumbo roll will be described. FIG. 1 shows the sectional structure of a film constituting a jumbo roll and FIG. 2 is its plan. As shown in FIGS. 1 and 2, as for a film 1 of the jumbo roll, a backcoating layer 3 is applied to the back of a thin polyethylene film 2 with a thickness of approximately a few μm. A parting layer (hereinafter called an undercoat layer) 5 is applied to the surface of the polyethylene film 2. As the back coating layer 3 is a part with which a head of a thermal transfer printer described later directly comes in contact, it is applied to the thin polyethylene film 2 because of an improvement of heat resistance and lubricity. The undercoat layer 5 is applied to facilitate the transfer of sublimated ink from the film 2 in printing.

Yellow (Ye) ink is applied to a yellow ink area by printing. Magenta (Mg) ink is applied to a magenta ink area by printing. Cyan (Cy) ink is applied to a cyan ink area by printing. These areas are sequentially provided on the upper surface of the undercoat layer 5 at a predetermined interval. An ink void area arranged at the predetermined interval is formed are printed as the recording portion of the ink ribbon. In ink void area, a column mark and a sensor code 7 such as a bar code, which are the column information, are recorded. That is, in this case, as the jumbo roll is cut into three columns of A, B and C, the sensor code 7 is divided into a sensor code 7*a* for the column A, a sensor code 7*b* for the column B and a sensor code 7*c* for the column C, and a column mark composed of each cut-out English letter of A, B and C is included in an area of each sensor code 7*a,* 7*b* and 7*c.*

Figure 3:
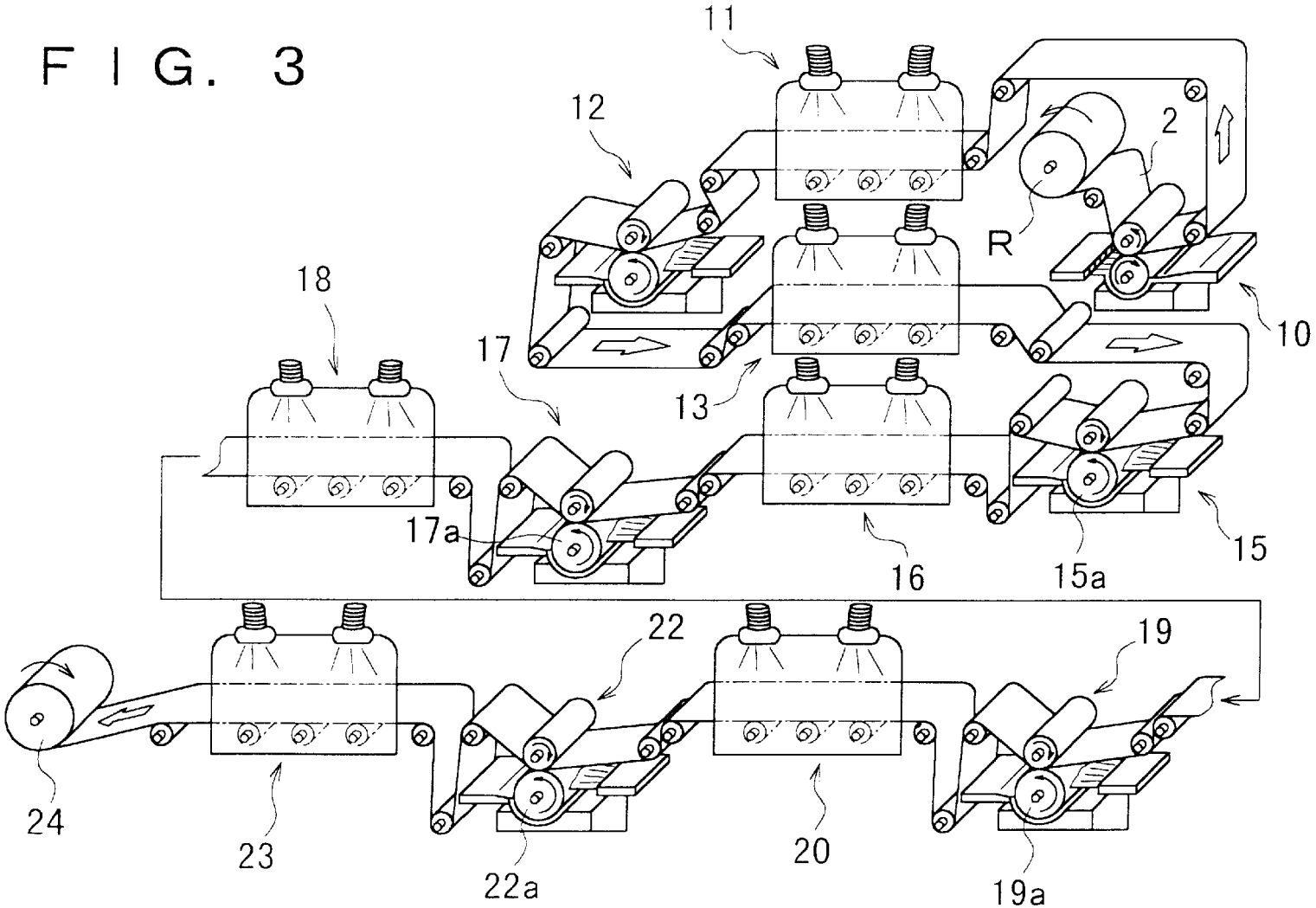
FIG. 3 is a schematic explanatory view showing the manufacturing process of the ink ribbon base film according to the present invention.

Next, the manufacture of the jumbo roll will be described. FIG. 3 is a schematic explanatory view showing the manufacturing process of the jumbo roll to which the present invention is applied.

The polyethylene film 2 is fed from a roll of raw polyethylene film R. The back coating layer 3 is applied to the back of the polyethylene film 2 by a coater 10 and dried by a drier 11. The undercoat layer 5 is applied to the surface of the polyethylene film 2 by a coater 12 and dried by a drier 13.

Yellow (Ye) ink is applied on the undercoat layer 5 by a gravure coater 15 and dried by a drier 16. Next, magenta (Mg) ink is applied to the undercoat layer 5 by a gravure coater 17 and dried by a drier 18.

Cyan (Cy) ink is applied to the undercoat layer 5 by a gravure coater 19 and dried by a drier 20. As described above, the ink void area is provided between ink areas, the yellow (Ye) ink area, the magenta (Mg) ink area and the cyan (Cy) ink area are sequentially applied in printing and drying. At this time, the respective print rolls 15*a,* 17*a* and 19*a* of the gravure coaters 15, 17 and 19 have the same large diameter. A part equivalent to approximately ⅓ of an outer periphery of each of the rolls 15*a,* 17*a* and 19*a* prints each of the inks, and a part equivalent to approximately ⅔ thereof prints no ink. The print rolls 15*a*, 17*a* and 19*a* are composed so that the phase of each print roll is off by 120 degrees. Therefore, the yellow (ye) ink area, the magenta (Mg) ink area and the cyan (Cy) ink area can be sequentially applied to the undercoat layer 5 in printing, providing the ink void area between the ink areas.

The sensor code 7 and the cut-out English letters A, B and C which are respectively the column mark are printed in each ink void area by a gravure printer 22. After they are dried by a drier 23, they are sequentially wound on a roll and then a jumbo roll 24 is manufactured.

A print roll 22*a* of the gravure printer 22 also has the same diameter as the print rolls 15*a,* 17*a* and 19*a* and the sensor code 7 is printed in the ink void area on the undercoat layer 5 at an interval equivalent to 120 degrees. As the sensor code 7 is divided into the sensor code 7*a* for the column A, the sensor code 7*b* for the column B and the sensor code 7*c* for the column C as shown in FIG. 2. Each column mark of the cutout English letters of A, B and C is included in each sensor code 7*a,* 7*b* and 7*c*. Therefore, the column to which an ink ribbon belongs can be discriminated visually from the plural columns manufactured by cutting the jumbo roll 24.

Figure 4:
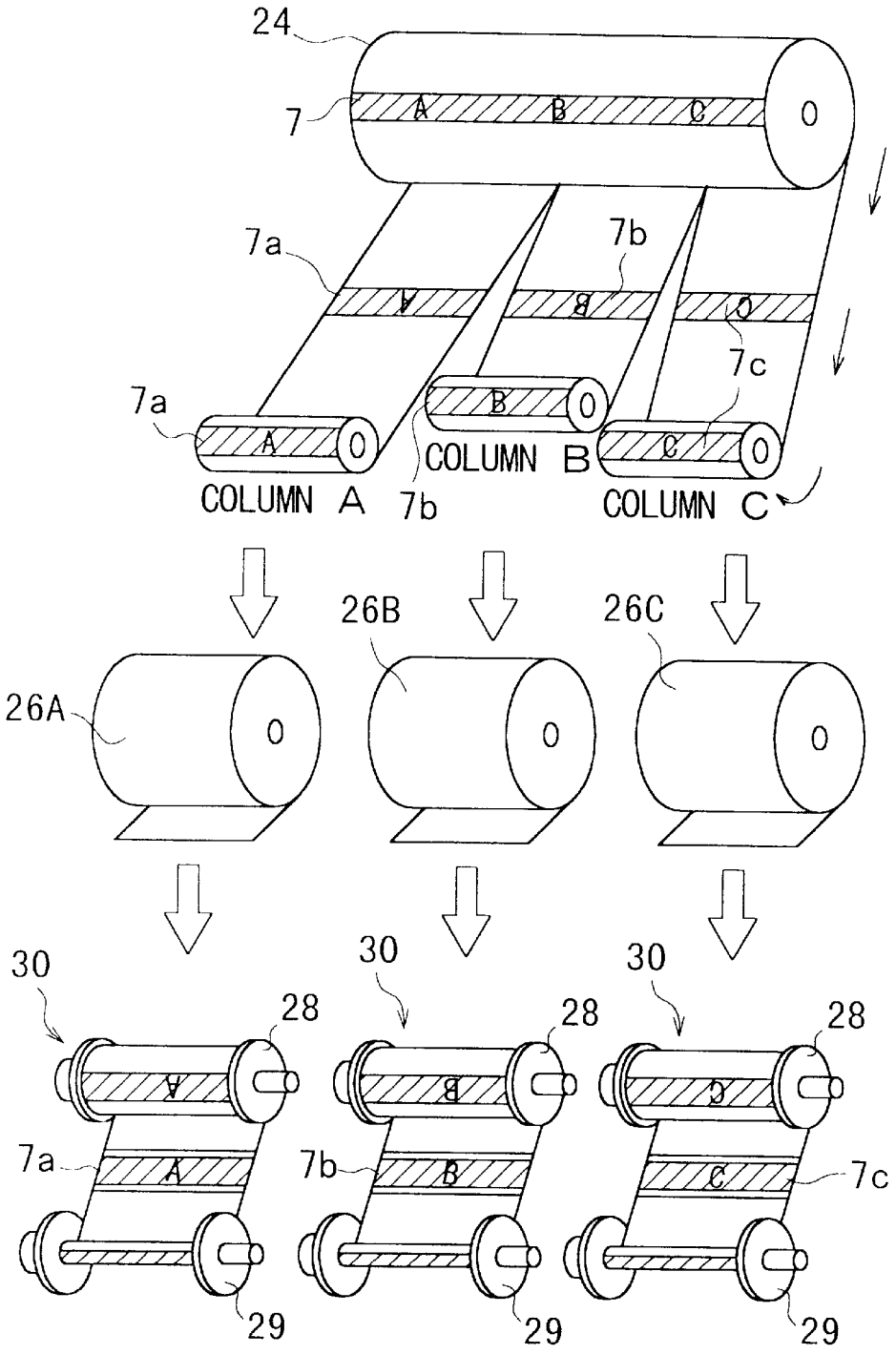
FIG. 4 is a schematic explanatory view showing a process for manufacturing an ink ribbon from the ink ribbon base film.

Next, an ink ribbon manufactured from the jumbo roll will be described. FIG. 4 is a schematic explanatory view showing a process for manufacturing an ink ribbon started with a jumbo roll. The jumbo roll 24 is cut into the width of an ink ribbon by a slitter, not shown, and is cut into three columns in this case.

A small wound pancake 26A for the column A, a small wound pancake 26B for the column B and a small wound pancake 26C for the column C are manufactured. An ink ribbon 30 is manufactured from each pancake 26A, 26B and 26C. For example, the ink ribbon 30 is manufactured by winding the cut film with predetermined length on a spool 28 on the supply side from the pancake 26A for the column A and winding an end of the cut film on a spool 29 on the winding side. As described above, plural ink ribbons 30 are manufactured from the pancakes 26A, 26B and 26C, respectively.

Figure 5:
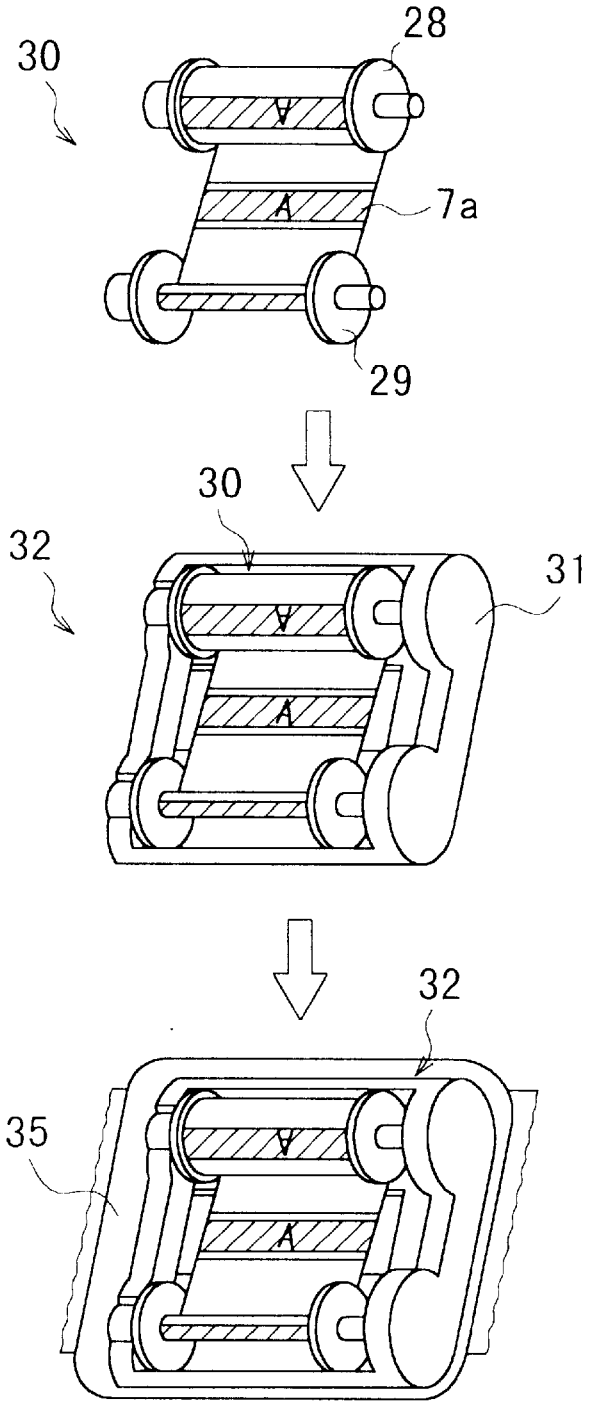
FIG. 5 is a schematic explanatory view showing a process for manufacturing an ink ribbon cassette containing the ink ribbon.

FIG. 5 is a schematic explanatory view showing a process for manufacturing an ink ribbon cassette including an ink ribbon.

An ink ribbon cassette 32 is manufactured by installing the ink ribbon 30 in a cassette case 31 and sealed in a package 35 made of synthetic resin. The above package 35 prevents ink from drying and enables long-term storage.

Figure 6:
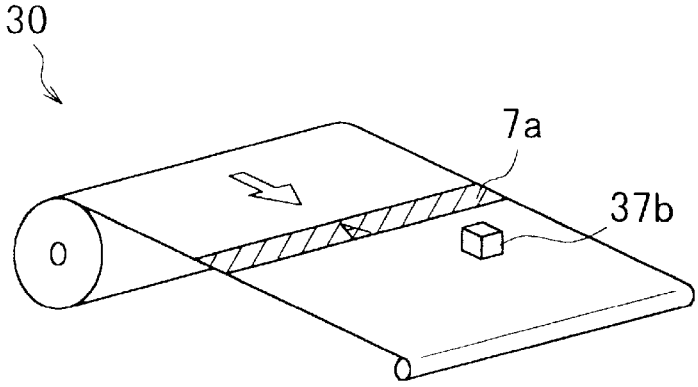
FIG. 6 is a view showing the arrangement of an ink ribbon set in a thermal transfer printer and a transmitted light detection-type optical sensor.
Figure 7A:
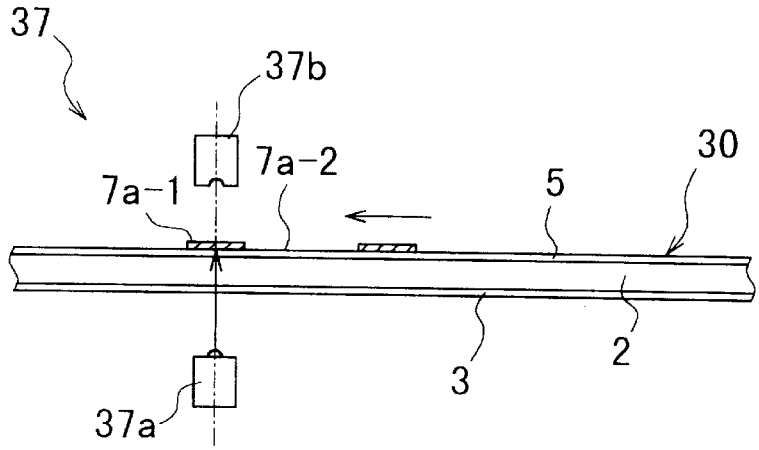
FIG. 7A and 7B are a view explaining the operation of the transmitted light detection-type optical sensor in relation to the ink ribbon.
Figure 7B:
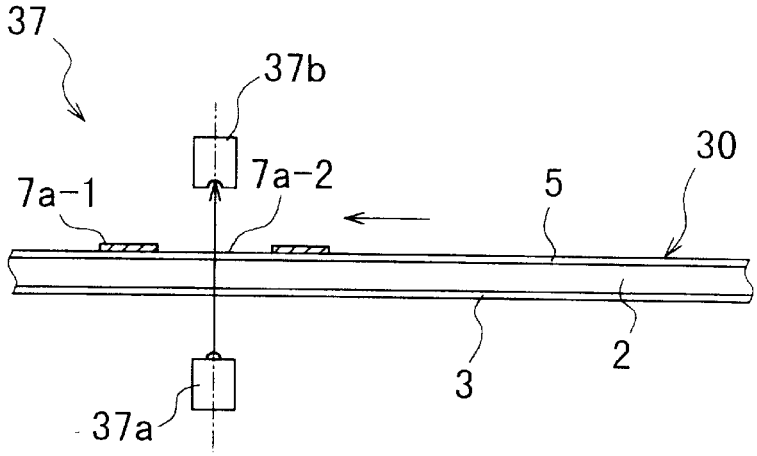

FIG. 6 shows the arrangement of an ink ribbon set in a thermal transfer printer and a transmitted light detection-type optical sensor and FIG. 7 is an explanatory view showing the operation of the transmitted light detection-type optical sensor in relation to the ink ribbon. As shown in FIGS. 6 and 7, in the ink ribbon 30 manufactured from the column A of the jumbo roll 24, the sensor code 7*a* composed of, for example, a bar code is printed in an ink void area on the undercoat layer 5 applied to the surface of the polyethylene film 2. In the sensor code 7*a,* there are a black mark portion 7*a*-1 and a portion 7*a*-2 adjacent to the black mark portion in which no black mark is printed. In a thermal transfer printer, not shown, a light projecting part 37*a* of the transmitted light detection-type optical sensor 37 is provided on the rear side of the ink ribbon 30 with the ink ribbon 30 being set. A light receiving part 37*b* of the transmitted light detection-type optical sensor 37 is provided on the side of the surface of the ink ribbon 30. A film of the ink ribbon 30 is wound in a direction shown by an arrow in FIG. 6 with a spool arranged on the winding side.

As shown in FIG. 7(*a*), as light projecting part 37*a* of the transmitted light detection-type optical sensor 37 projects light, the light passes through the respective transparent backcoating layer 3, polyethylene film 2 and undercoat layer 5 and is projected onto the black mark portion 7*a*-1. Since the projected light is screened by the black mark portion 7*a*-1, the quantity of light received by the light receiving part 37*b* of the transmitted light detection-type optical sensor 37 is extremely small.

Further, as shown in FIG. 7(*b*), as the light projecting part 37*a* of the transmitted light detection-type optical sensor 37 projects light, the light passes through the respective transparent backcoating layer 3, polyethylene film 2 and undercoat layer 5 and is projected onto the portion 7*a*-2. Since no black mark is printed in the portion 7*a*-2, the projected light is not screened by the portion 7*a*-2. Therefore, the quantity of light received by the light receiving part 37*b* of the transmitted light detection-type optical sensor 37 is much.

The transmitted light detection-type optical sensor 37 outputs a signal showing whether the black mark is detected or not based upon difference in the quantity of received light.

In the sensor code 7*a,* various manufacturing information is recorded and in its area, a column mark composed of the cut-out English letter of A showing that the corresponding ink ribbon is manufactured in the column A of the jumbo roll 24 is included. Hereby, if failure such as the unevenness of coating occurs in an ink ribbon, it can be identified that a column A of the jumbo roll 24 includes the failure based upon the column mark of A in the sensor code 7*a* of the corresponding ink ribbon.

A column of the jumbo roll 24 from which the corresponding ink ribbon is manufactured can be determined based upon the column marks of A, B and C in the sensor codes 7*a,* 7*b* and 7*c.* Therefore, if a failure such as the unevenness of coating occurs in the ink ribbon, a column of the jumbo roll 24 from which the corresponding ink ribbon is manufactured can be identified and then the failure location, namely, the failed column of the jumbo roll can be discriminated.

Also, as only the column mark is added to the area of the sensor code, conventional ink ribbon manufacturing process and manufacturing facilities can be used as they are. Therefore, the manufacturing process and time are not increased and the cost of the facilities is also not increased.

In the above embodiment, the column marks respectively consisting of the cutout English letters of A, B and C are used for column information. However, the present invention is not limited to these and another letter or mark and others which can be discriminated visually as a column mark may be also used. Further, the discrimination of column information by a sensor may be also enabled by including the column information in a sensor code readable by various sensors.

Also, the jumbo roll is cut into three columns in the above embodiment. However, the present invention is not limited to this and it is natural that the jumbo roll maybe also cut into another plural columns such as two and four columns.

The sensor code and the column marks are provided between the ink areas in the above embodiment. However, the present invention is not limited to this and a sensor code and a column mark may be also provided only at the top of the yellow ink area.

In the above embodiment, the transmitted light detection-type optical sensor is used for a thermal printer. However, the present invention is not limited to this and it is natural that a reflected light detection-type optical sensor may be also used.

As described above, according to the present invention, as the ink ribbon comprises a recording portion indicating column information about a column out of the plural columns of jumbo roll, from which an ink ribbon is manufactured, if the failure such as the unevenness of coating of each color ink occurs in the ink ribbon, a column including the failure can be discriminated from the plural columns of the jumbo roll based upon the column information of the corresponding ink ribbon. Therefore, the location of the failure on the ink ribbon base film can be discriminated.

Also, as the recording portion indicating column information is provided between the ink areas of an ink ribbon, the column information can be readily known if failure such as the unevenness of coating of each color ink occurs in the ink ribbon.

As the recording portion indicating column information is a mark that is able to be printed by a printer, the mark can be printed in the manufacturing line without reducing the speed of the manufacturing line of the ink ribbon base film and then the productivity thereof can be enhanced.

When the mark is composed of a sensor code, column information can be readily read using a sensor code reader, the technique of which is established, the reading precision of which is high and which is low-priced.

While the above is a complete description of the preferred embodiments of the invention, various alternatives, modifications and equivalents may be used. Therefore, the above description should not be taken as limiting the scope of the invention as defined by the appended claims.

What is claimed is:

1. In an ink ribbon of the type manufactured by cutting an ink ribbon base film into plural columns, the improvement comprising a recording portion on the ink ribbon base film on which is recorded distinct and different column information separately identifying each column of the plural columns.

2. The ink ribbon according to claim 1, wherein:

the ink ribbon base film has ink coated areas of different types of ink; and the recording portion is provided on the ink ribbon base film between the ink coated areas.

3. The ink ribbon according to claim 1, wherein the recording portion includes a printed mark.

4. The ink ribbon according to claim 3, wherein the printed mark comprises a sensor code.

5. In combination, an ink ribbon of the type manufactured by cutting an ink ribbon base film into plural columns, the ink ribbon including a recording portion on which is recorded distinct and different column information identifying a column out of the plural columns of the ink ribbon base film, from which the ink ribbon was manufactured, and a cartridge containing the ink ribbon.

6. The combination according to claim 5, wherein:

the ink ribbon has ink coated areas covered with plural types of ink; and the recording portion is provided between the ink coated areas.

7. The combination according to claim 5, wherein the recording portion includes a printed mark.

8. The combination according to claim 7, wherein the printed mark comprises a sensor code.

9. A method of identifying a failed column of an ink ribbon base film that has been cut into plural columns of separate ink ribbons during manufacture of the separate ink ribbons, comprising the steps of:

recording distinct and different information on each column of the ink ribbon base film during manufacture of the ink ribbons, wherein the information separately identifies each column; and detecting the information when a failure occurs on an ink ribbon cut from the ink ribbon base film.

10. The method according to claim 9, wherein the step of recording the information takes place before the ink ribbon base film is cut into the plural columns of ink ribbons.

* * * * *